US007980560B2

(12) United States Patent
Belykh

(10) Patent No.: US 7,980,560 B2
(45) Date of Patent: Jul. 19, 2011

(54) THREE-DIMENSIONAL TUBE PUZZLE

(76) Inventor: Igor Belykh, Palo Alto, CA (US)

( * ) Notice: Subject to any disclaimer, the term of this patent is extended or adjusted under 35 U.S.C. 154(b) by 0 days.

(21) Appl. No.: 12/111,976

(22) Filed: Apr. 30, 2008

(65) Prior Publication Data

US 2009/0273139 A1 Nov. 5, 2009

(51) Int. Cl.
*A63F 9/08* (2006.01)

(52) U.S. Cl. ..... 273/153 S

(58) Field of Classification Search ..... 273/153 R, 273/153 S, 113, 109, 123 R; 446/102, 487
See application file for complete search history.

(56) References Cited

U.S. PATENT DOCUMENTS

| | | | | |
|---|---|---|---|---|
| 3,900,984 | A * | 8/1975 | Garelick | 446/487 |
| 4,008,895 | A * | 2/1977 | Reiner et al. | 273/153 R |
| 4,232,473 | A * | 11/1980 | Jenkins | 446/102 |
| 4,378,116 | A * | 3/1983 | Rubik | 273/153 S |
| 4,378,117 | A * | 3/1983 | Rubik | 273/153 S |
| 4,410,179 | A | 10/1983 | Rubik | |
| 4,421,311 | A | 12/1983 | Sebesteny | |
| 4,511,144 | A | 4/1985 | Roberts | |
| 4,545,577 | A * | 10/1985 | Randleman | 273/113 |
| 4,600,199 | A | 7/1986 | Krell | |
| 4,706,956 | A | 11/1987 | Abu-Shumays et al. | |
| 4,708,345 | A | 11/1987 | Ayers | |
| 4,754,972 | A * | 7/1988 | Boskovic | 273/153 S |
| 4,861,036 | A * | 8/1989 | Watanabe | 273/153 R |
| 4,881,738 | A | 11/1989 | Ayers | |
| 4,953,863 | A * | 9/1990 | Zeidler et al. | 273/113 |
| 5,116,052 | A | 5/1992 | Pop | |
| 5,176,382 | A | 1/1993 | Hausammann | |
| 5,184,822 | A * | 2/1993 | Bognar et al. | 273/153 R |
| 5,265,873 | A * | 11/1993 | Szilagyi | 273/113 |
| 5,358,247 | A | 10/1994 | Meffert | |
| 5,452,895 | A | 9/1995 | Ray | |
| 5,558,331 | A | 9/1996 | Zlotsky | |
| 5,645,278 | A | 7/1997 | Harris | |
| 5,845,904 | A | 12/1998 | Hawkins | |
| 6,139,015 | A * | 10/2000 | Hsieh | 273/153 S |
| 6,217,023 | B1 | 4/2001 | Kremer | |
| 6,523,825 | B2 * | 2/2003 | Francis | 273/153 R |
| 6,568,679 | B1 * | 5/2003 | Sommer | 273/153 R |
| 6,644,665 | B1 | 11/2003 | Brooks | |
| 6,883,802 | B2 | 4/2005 | Rom | |
| 6,974,130 | B2 | 12/2005 | Sugden | |
| 7,165,768 | B2 * | 1/2007 | Fang et al. | 273/153 S |

FOREIGN PATENT DOCUMENTS

| | | |
|---|---|---|
| BE | 887885 | 7/1981 |
| DE | 3104021 A1 | 12/1982 |
| HU | 170062 | 1/1975 |
| HU | 214709 | 7/1998 |

* cited by examiner

*Primary Examiner* — Steven Wong

(57) ABSTRACT

A three-dimensional tube puzzle is disclosed as a new modification of Rubik's Cube™. It consists of plurality of straight and curved cylindrical elements. The dimensions of each element are so that it fits into cubical cell. Assembled puzzle forms a continuous pipeline that fits into cubical space, wiggling from starting element to ending element. Elements are interconnected so that groups of nine elements, belonging to one of six side surfaces of the puzzle, can be rotated about spatial axes. Each element or layer of the puzzle can be made of the same one color or different colors or gray scale levels to define puzzle difficulty. The subject puzzle requires specific imagination skills to assemble a continuous pipeline based on elements' shapes and orientation. Cylindrical elements can be made hollow with opened ends so that the assembled puzzle forms a continuous tube path for an article of an appropriate size to pass through the puzzle.

14 Claims, 14 Drawing Sheets

A

B

THREE-DIMENSIONAL TUBE PUZZLE

FIELD OF THE INVENTION

This invention relates to three-dimensional puzzle toys, and in particular, to manipulable puzzles containing rotatable elements.

BACKGROUND OF THE INVENTION

The known in the art Rubik's Cube™ puzzle consists of 26 cubic elements and interior central connecting mechanism. As disclosed by Rubik in HU 170,062 and later by Sugden in U.S. Pat. No. 6,974,130 cubic elements are connected to neighbor elements or to central mechanism by cam connectors of specific shapes. Those connectors are attached to unexposed part of cubic elements. Assembled puzzle has six flat exposed outer surfaces each formed by nine surfaces of cubic elements, which are used to formulate the puzzle problem to be solved, e.g. they can carry colors, patterns, figures, symbols, signs or else. All cubic elements are connected so that any of nine elements, belonging to the same outer surface of the cube can be rotated about the axis going through the center of that surface and puzzle geometrical center. The object of the game is to restore the initial undisturbed state of the cube from its disturbed state by means of rotation of groups of nine elements.

Since classic 3×3×3 cube is difficult to solve for many children there were efforts in the art to change the level of difficulty. Rubik's Cube™ puzzle level of difficulty depends on number of combinations defined by total number of elements, and can be reduced as disclosed by Rubik in U.S. Pat. No. 4,378,116 for 2×3×3 cube and U.S. Pat. No. 4,378,117 for 2×2×2 cube or can be increased as disclosed by Sebesteny in U.S. Pat. No. 4,421,311 for 4×4×4 cube or by Krell in U.S. Pat. No. 4,600,199 for 5×5×5 cube. The assembly difficulty can also be reduced by increasing the number of possible solutions by means of using less colors, e.g. two- or three-color cube or cube with two-color patterns disclosed by Sugden in U.S. Pat. No. 6,974,130. In this case not all elements will have their unique position. Although reducing number of colors without changing element shape can significantly simplify Rubik's puzzle and can lead to loss of motivation. Thus there is a need for a puzzle with a motivating balance between number of elements, their colors and shapes.

Imagination skills required to solve Rubik's cube puzzle of all sizes and its spherical or other geometrical and stereo metrical modifications are based on outer surface color or pattern perturbation, which might be not suitable for those children or adults, who prefer spatial relationships to color ones, or for color-blind or blind people. Thus there is a need for element shape variation to develop players' different imagination skills.

There are 3-D puzzles known in the art referenced in the present invention that use not only colors but also shapes of rotatable elements. Amusement device disclosed by Ayers in U.S. Pat. Nos. 4,708,345 and 4,881,738 used cylindrical shape of elements forming a regular polygon and rotatable about their longitudinal axis and divided into halves rotatable about axis orthogonal to polygon plane to assemble the puzzle. Those puzzles use outer surfaces as a key for puzzle problem formulation and/or solution but they do not use puzzle interior space. Thus there is a need for using of puzzle internal 3-D space to make it more entertaining and challenging and with variable level of difficulty.

SUMMARY OF THE INVENTION

A three-dimensional tube puzzle is presented in the current invention as a new modification of known 3×3×3 Rubik's cube puzzle. It consists of plurality of cylindrical elements of two main exposed shapes: straight cylinder (Coupling) and corner cylinder (Elbow). The dimensions of each element are so that it fits into a cubical cell. Assembled tube puzzle fits into cubical space. Due to spatial relationships of the disclosed 3×3×3 tube puzzle there is one cell remaining unfilled by cylindrical elements and it can be filled out by an element of exposed spherical shape. Cylindrical elements have arm-and-cam connectors that are based on modification of cam connectors disclosed by Rubik in HU 170,062 and U.S. Pat. No. 4,378,116 and by Sugden in U.S. Pat. No. 6,974,130 by means of adding extension arms of specific shapes for different types of elements. All cylindrical elements can be interconnected by those arm-and-cam connectors to neighbor elements or to puzzle interior central connecting mechanism, using the same mechanical principles disclosed by Rubik, so that any nine elements, belonging to one of six side surfaces, can be rotated about the central axis going through the central element of that one surface and through puzzle interior central mechanism. Unexposed part of each cylindrical element consists of one part, which is similar in shape to the same unexposed part of cubic element with flat surfaces in each spatial dimension formed by respective number of parallel or perpendicular edges in order to provide stable rotation of element arrays, and another part, which is modified to pyramidal shape to provide enough space for modified arm-and-cam connectors to pass through while rotation. Both modifications of either extended arm-and-cam connectors and of unexposed parts of cylindrical elements require the sizes for internal rotatable surfaces and parts for element interconnection to be reduced to fit into the space limited by central element cell.

There are total 26 elements forming the 3×3×3 element puzzle of the present invention: 25 elements of exposed cylindrical shape, including 16 Elbows and 9 Couplings, and one element of exposed spherical shape.

In its undisturbed initial state the puzzle represents a continuous pipeline structure of 3×3×3 straight and curved cylindrical elements, wiggling from its starting element to its ending element inside cubical space. The puzzle is solved when the whole pipeline is assembled from its disturbed state. The game can be played in a competitive way measuring a progress by time or by number of moves spent to solve the puzzle completely.

In order to vary the level of puzzle difficulty all cylindrical elements can be the same one color or transparent. In this case element shape and orientation will be the main criteria to solve the puzzle. Although not all elements will have their unique positions, which will increase the number of puzzle possible solutions and will lower the level of difficulty. Such version of the present invention puzzle can be designed as an entry level tube puzzle for children younger than 8 years old (a recommended age for Rubik's cube) or for blind children and adults. The next level of difficulty can be designed using three colors, e.g. one for each of three layers of the tube puzzle. The number of possible solutions will be reduced compare to single-color version, because there will be three different groups of elements belonging to respective layers and each group should be assembled as a continuous pipeline using the shape and orientation criteria. This three-color tube puzzle can be designed as three-gray-scale-level version friendly for color-blind children and adults, e.g. Black-White-Gray. A multi-colored version of the disclosed tube puzzle can be designed in such a way that each cylindrical element has different color and all 25 elements represent a sequence color equivalent to discrete rainbow spectrum, i.e. from "infra-red" at starting point to "ultra-violet" at ending point, when each element color matches preceding and subsequent element colors in an undisturbed state of said puzzle, e.g. Dark Blue-Blue-Light Blue, and a container element can be white or black. In such version each cylindrical element will have a unique position and there will be only one solution for the disclosed tube puzzle as it is for classic Rubik's puzzle with the same level of difficulty but with additional stimulation of pipeline assembly. The disclosed tube puzzle can be also designed as a full gray-scale version when 25 cylindrical elements represent sequential levels of gray scale from black at starting point to white at ending point, and container element can be designed with a pattern. Those multi-colored or full gray-scale versions also introduce an encouraging opportunity for younger children: first to assemble the whole pipeline without matching colors or gray-scale levels for training and entertainment and for releasing a hidden article, and then to try to assemble the puzzle with all colors or gray-scale levels matched. Cylindrical elements also can be numbered or patterned or can have any signs or symbols to form a predefined logical sequence of the elements.

Each tube element can be made of plastic or other synthetic material of appropriate color using injection-molding technology. All cylindrical elements and their arm-and-cam connectors can be produced hollow in order to save material. The ends of each cylindrical element can be made opened. In this case the interior of the solved puzzle can represent a tube path and an article, e.g. ball, of appropriate size that can be put through the puzzle from its entry point at its top layer to its exit point at its bottom layer (or visa-versa). The element with exposed spherical shape can be designed as a Container element with detachable cap to keep an article and can be positioned in the center of puzzle side with ending point.

As described above, the disclosed in present invention three-dimensional tube puzzle stimulates player's spatial imagination skills to assemble a continuous pipeline structure using shape and orientation criteria and if designed colors or gray-scale levels or patterns or other signs or symbols. The disclosed tube puzzle uses its internal 3-D space and provides additional motivation and amusement features compare to puzzles with rotatable elements previously known in the art that use outer surfaces.

DETAILED DESCRIPTION OF PREFERRED EMBODIMENTS

Referring to FIGS. 1, 2, 11 and 12, illustrated therein is a three-dimensional tube puzzle 10 made in accordance with a preferred embodiment of the present invention.

Figure 1:
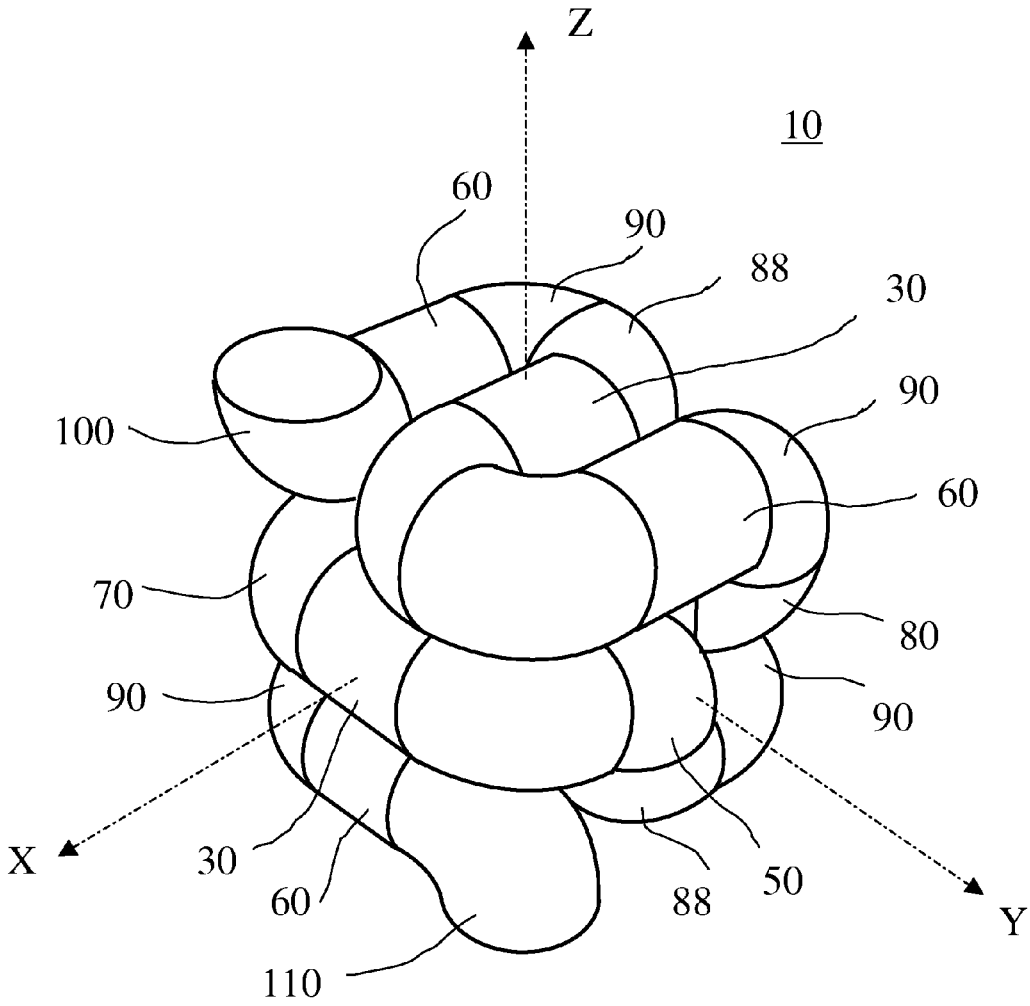
FIG. 1 represents three-dimensional tube puzzle in assembled state made in accordance with the preferred embodiment of the present invention.
Figure 2:
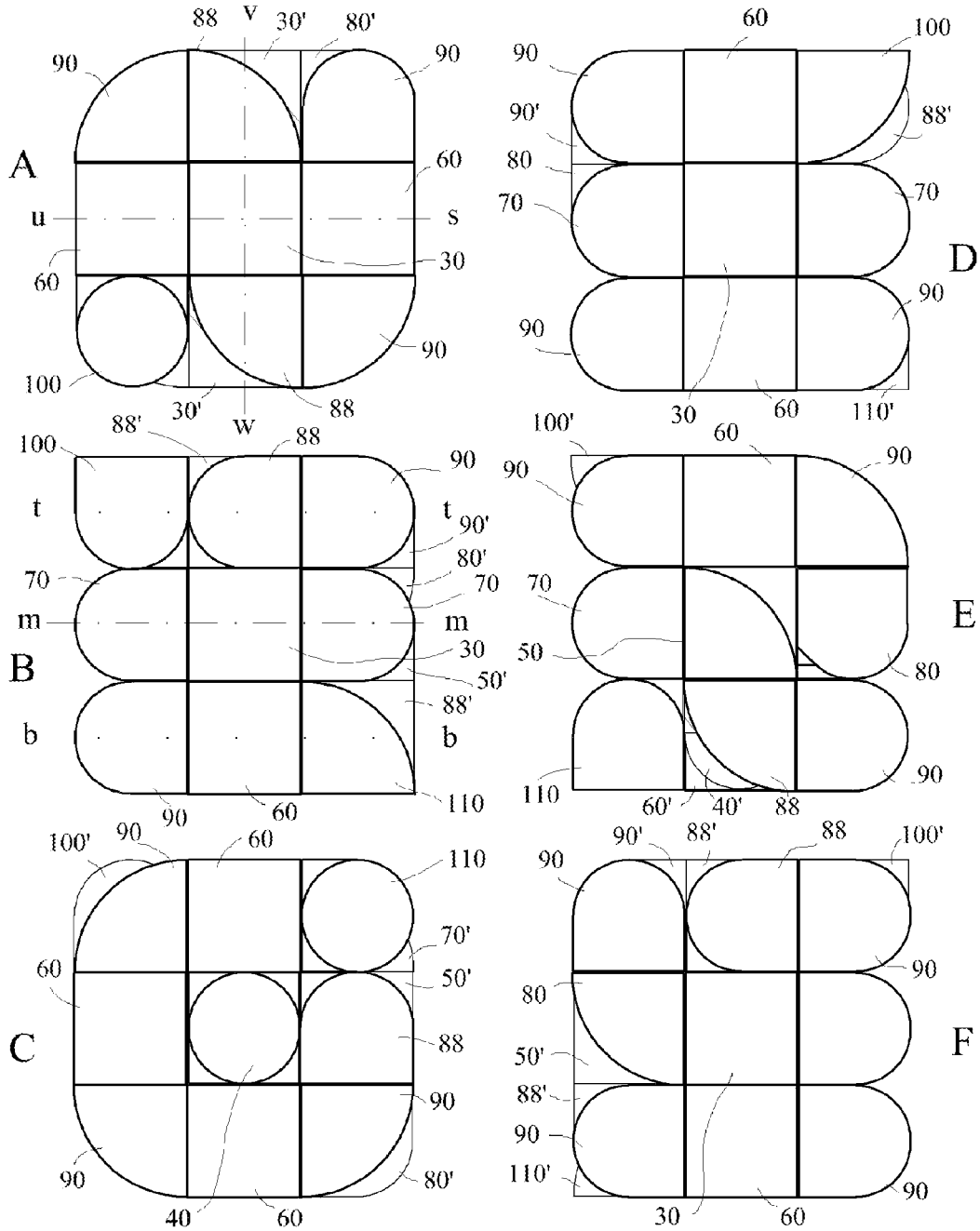
FIG. 2 shows views of six side surfaces of 3×3×3 tube puzzle: A—top, B—front, C—bottom, D—left, E—right, F—back.

FIG. 1 shows a volumetric view of assembled tube puzzle 10, consisting of 26 elements, connected so that an array of any 9 elements, belonging to the same side surface of the puzzle, can be rotated about one of spatial axes X, Y, Z. The dimensions of each cylindrical element are so that it fits into cubical cell with suggested characteristic edge equal to about 1 inch, so that suggested characteristic dimensions of the tube puzzle can be equal to 3"×3"×3". An article 12 of the size smaller than internal tube diameter can be put though the puzzle from its entry point 14 and released at its exit point 16. Other numbers designate different type of tube elements disclosed in the present invention.

Six side surfaces of the disclosed puzzle 10 are shown on FIGS. 2A-2F: A—top, B—front, C—bottom, D—left, E—right, F—back. Puzzle layers can be identified as: Top, Middle and Bottom, as indicated by lines t-t, m-m and b-b respectively in FIG. 2B. Hereinafter the numbers designate fully visible elements, e.g. 30, and numbers with apostrophe sign designate partly visible elements, e.g. 30'.

FIGS. 3-10 represent volumetric and plane views of cylindrical elements that are divided into three main groups based on their spatial position, exposed shape and type of connectors.

Figure 3:
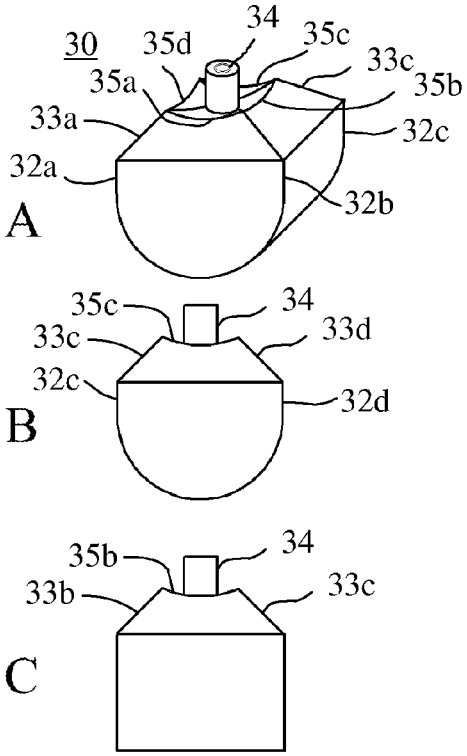
FIG. 3 represents views of cylindrical elements belonging to the first sub-group of the first group.
Figure 4:
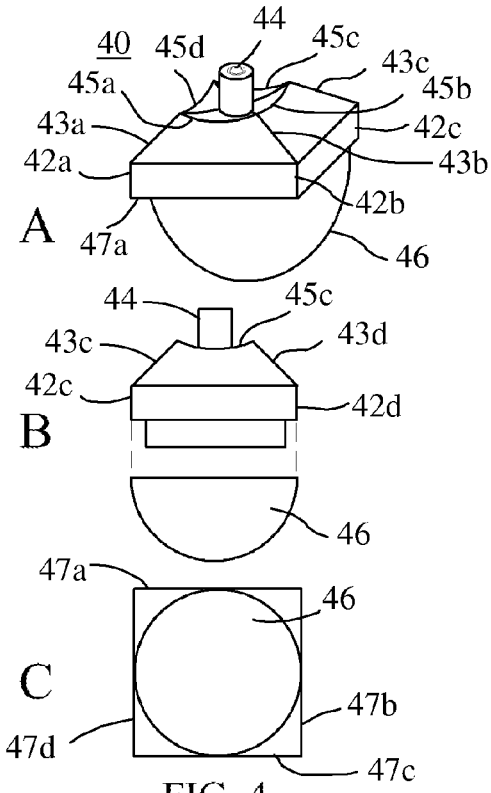
FIG. 4 represents views of cylindrical elements belonging to the second sub-group of the first group.
Figure 5:
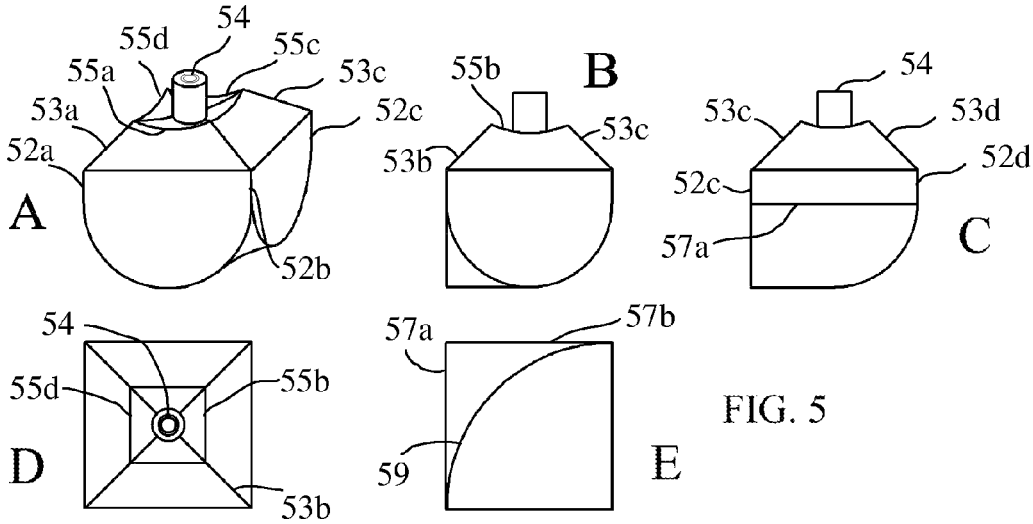
FIG. 5 represents views of cylindrical element belonging to the third sub-group of the first group.

FIGS. 3-5 represent the first group of six cylindrical elements that are positioned in the center of each of six puzzle side surfaces and are rotatable in one plane. Those six elements have identical unexposed surfaces and arm connectors to be connected to the central connecting mechanism but are divided into 3 sub-groups based on their exposed shape and orientation. FIG. 3 shows the sub-group of four Couplings 30. FIG. 3A is a volumetric view, FIG. 3B is a backside view and FIG. 3C is a side view of central Coupling element. Exposed surface of that hollow Coupling has cylindrical shape and its unexposed surface has complex shape formed by cubic basement with four identical parallel edges 32*a-d* that are cut-off at 45 degrees from each of four sides forming a shape of pyramid with four identical edges 33*a-d* that provide enough space for passing of neighbor and corner elements connector arms. Top of that pyramid is cut-off by a crossing of four spherical surfaces with four identical edges 35*a-d* that provide smooth sliding of cam connectors of an array of neighbor elements in a respective plane of rotation. On top of that multi-spherical surface there is a cylindrical arm connector 34 that connects to puzzle central connecting element following the same mechanics disclosed by Rubik in HU 170,062. Cubic part creates flat side surfaces to stabilize sliding motion of neighbor element arrays while rotation.

FIG. 4 represents the fifth central element 40, which can be used as a Container for an article 12. FIG. 4A shows a volumetric view, FIG. 4B shows back view and FIG. 4C shows bottom view of central Container element exposed surface. Unexposed surface of Container 42 has the same complex shape as Coupling central element, i.e. it has: a cubic part with four identical edges 42*a-d* and four identical edges 47*a-d* and a pyramid part with four identical edges 43*a-d*, which is cut-off by a crossing of four spherical surfaces forming four identical edges 45*a-d*, and a cylindrical arm connector 44. The exposed surface of Container 42 is shown in FIG. 4C and is formed by semi-spherical detachable cap 46, as shown on FIG. 4B, and by visible four corners of Container cubic part formed by edges 47*a-d*. The Container element 40 is designed to fill out the remaining empty $26^{th}$ cell, which cannot be filled by any cylindrical element due to spatial relationships of the tube puzzle 10 disclosed in present invention.

FIG. 5 represents the sixth central Elbow element 50. FIG. 5A shows a volumetric view, FIG. 5B shows right side view, FIG. 5C shows backside view, FIG. 5D shows topside view (unexposed surface) and FIG. 5E shows bottom side view (exposed surface) of central Elbow element. Unexposed surface of Elbow 50 has the same complex shape as Coupling and Container central elements, i.e. it has: a cubic part with four identical edges 52*a-d* and two identical edges 57*a, b* and a pyramid part with four identical edges 53*a-d*. The pyramid part is cut-off by a crossing of four spherical surfaces with four identical edges 55*a-d*. A cylindrical arm connector 54 is on top of that multi-spherical crossing surface. The exposed surface of Elbow 50 is shown in FIG. 5E and is formed by corner element arc 59 and by visible corner of cubical part with edges 57*a, b*. The role of cubic part of each central element described above is to block visibility of internal central connector and intrusion of any objects inside puzzle to prevent its damage.

Figure 6:
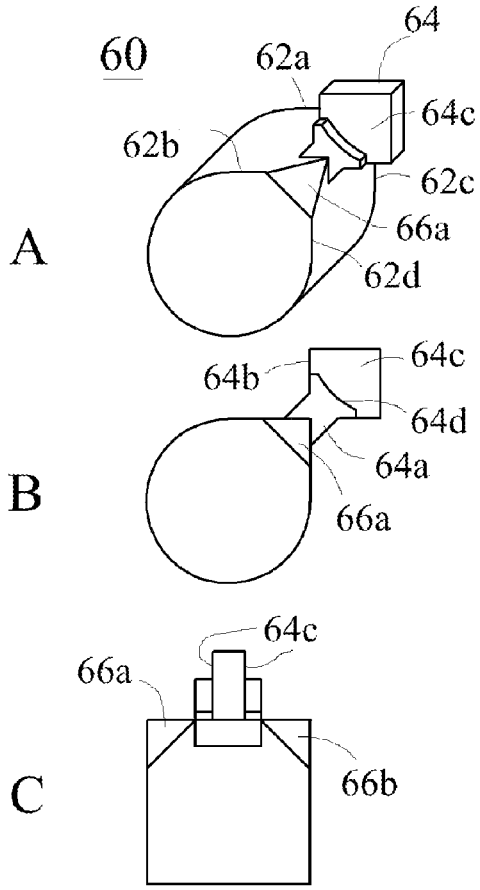
FIG. 6 represents views of cylindrical elements belonging to the first sub-group of the second group.
Figure 7:
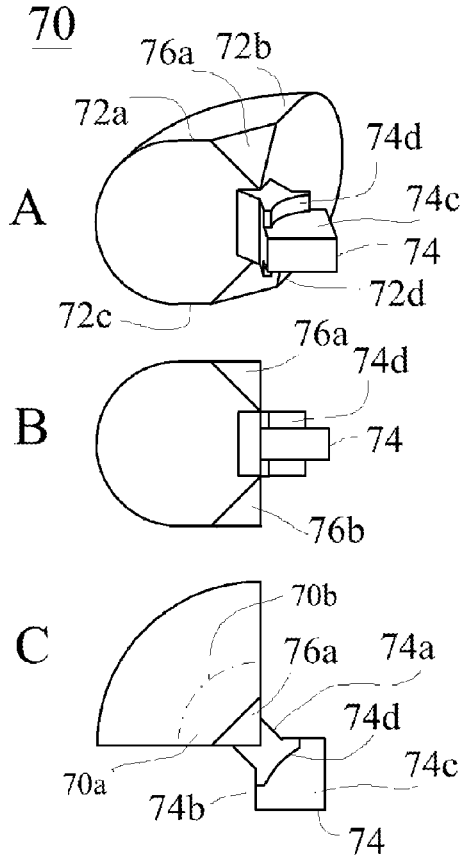
FIG. 7 represents views of cylindrical elements belonging to the second sub-group of the second group.
Figure 8:
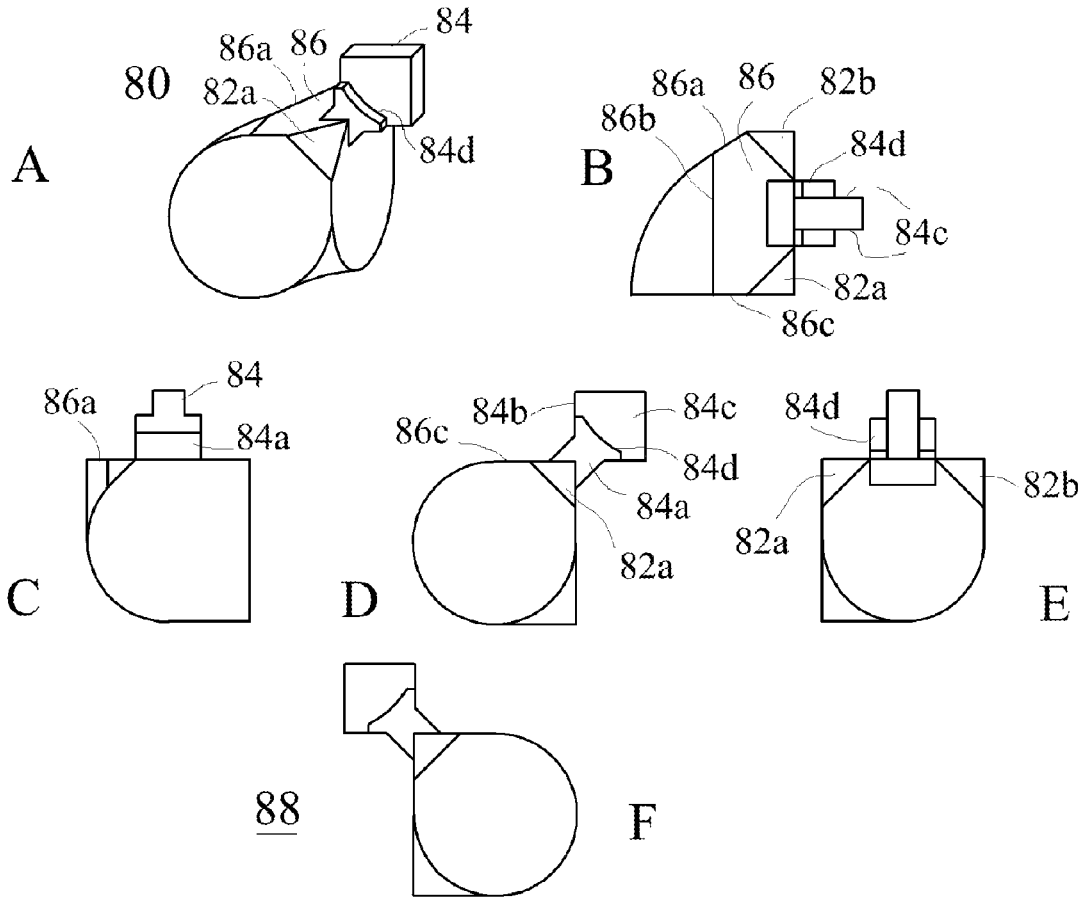
FIG. 8 represents views of cylindrical elements belonging to the third sub-group of the second group.

FIGS. 6-8 represent the second group of twelve cylindrical elements that are positioned in the middle of each edge formed by any two side surfaces of the present puzzle and are rotatable in two perpendicular planes. Those twelve elements have identical arm-and-cam connectors with cam part having a shape of square cuboids but are divided into 3 sub-groups based on their exposed shape and orientation. FIG. 6 represents the first sub-group of five mid-Couplings 60. FIG. 6A shows volumetric view, FIG. 6B shows front view and FIG. 6C shows side view of mid-Coupling 60. The exposed part of mid-Coupling 60 has cylindrical shape and its unexposed part is formed by a crossing of two flat surfaces with edges 62*a, b* and 62*c, d*. The edge formed by a crossing of those two flat surfaces is not exposed because its both corners are cut-off at 45 degrees to each spatial axis forming two flat triangular surfaces 66*a, b* that provide enough or the arms of neighbor elements' connectors. Between those two triangles there is an attached arm-and-cam connector 64, which has an extension arm 64*a* ended with a cam 64*b*. Arm-and-cam connectors have two functions: to keep mid-Coupling elements between two central elements shown in FIGS. 3-5 and to receive and hold cam connectors of neighbor corner elements shown in FIGS. 9-10 by its flat surfaces 64*c* with bordering part formed by a fragment of cylindrical surface 64*d*.

FIG. 7 represents the second sub-group of three mid-Elbows 70. FIG. 7A shows volumetric view, FIG. 7B shows front view and FIG. 7C shows top view of cylindrical element 70 with arm-and-cam connector 74, which has the same structure and respective features 74*a-d* as connector 64 but is attached to the center of the edge located between two ends of the cylindrical element. There are two identical flat surfaces at the top 70*a* and the bottom of element 70 with edges 72*a, b* and 72*c, d* respectively limited by arc 70*b* going along the central axis of curved cylindrical element. Two corners adjacent to connector 74 are cut-off at 45 degrees to each of spatial axis forming two flat triangular surfaces 76*a, b* to provide enough space for the arms of neighbor corner elements' connector.

FIG. 8 represents the third sub-group of four mid-Elbows including one Elbow 80 and three Elbows 88. FIG. 8A shows volumetric view, FIG. 8B shows top view, FIG. 8C shows left side view, FIG. 8D shows front view and FIG. 8E shows right side view of mid-Elbow 80 with arm-and-cam connector 84. Connector 84 has the same structure and respective features 84*a*, 84*b*, 84*c*, 84*d* as connectors 64 and 74 described above. Connector 84 is attached to one end of element 80 at the center of the edge formed by two perpendicular planes: a flat surface 86 with edges 86*a*, 86*b* and 86*c* and a plane going through that end of cylindrical element 80. Two corners adjacent to connector 84 at both sides are cut-off at 45 degrees to each of spatial axis forming flat triangular surfaces 82*a, b* to provide enough space for the arm of neighbor corner elements' connectors. Another three mid-Elbows 88 are exact minor reflected copies of element 80, as shown in FIG. 8F.

Figure 9:
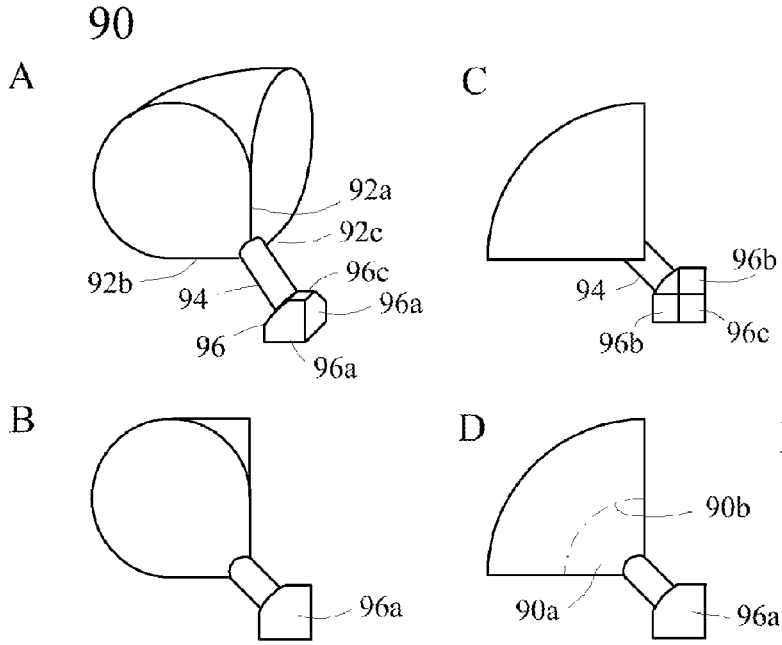
FIG. 9 represents views of cylindrical elements belonging to the first sub-group of the third group.
Figure 10:
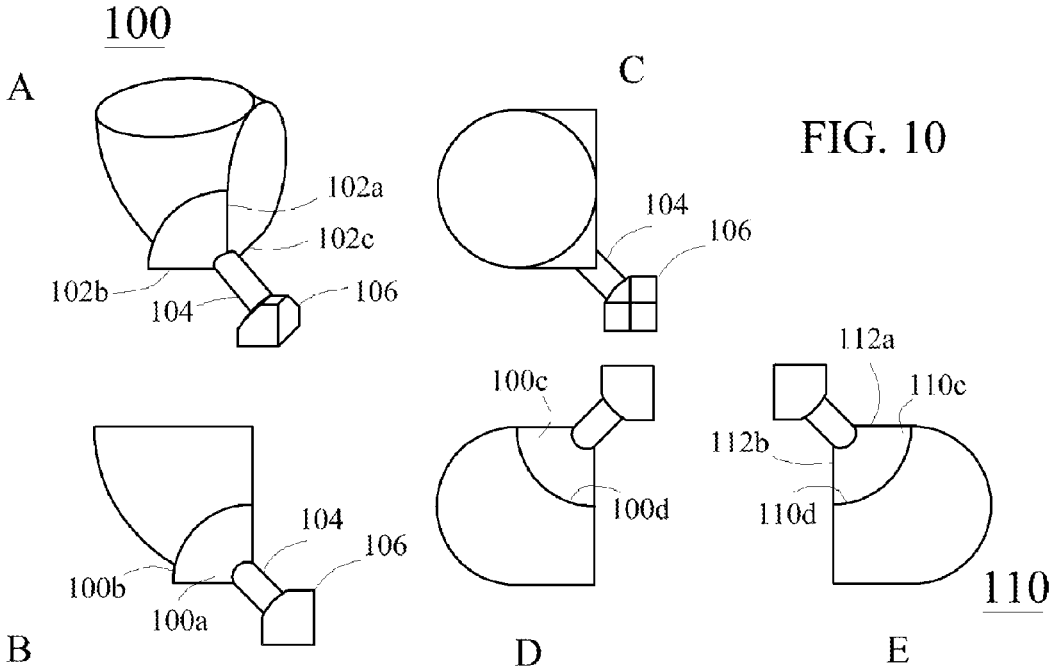
FIG. 10 represents views of cylindrical elements belonging to the second sub-group of the third group.

FIGS. 9-10 represent the third group of eight corner cylindrical elements that are positioned in the corners of the puzzle disclosed in present invention and are rotatable in three planes about spatial axes. Those corner-Elbows have identical shape of arm-and-cam connectors and are divided into 2 sub-groups based on their orientation, function and unexposed shape. FIG. 9 represents the first sub-group of six corner-Elbows 90. FIG. 9A shows volumetric view, FIG. 9B shows front view, FIG. 9C shows top view and FIG. 9D shows bottom view of corner-Elbow 90. The unexposed part of corner-Elbow has a shape of cube corner formed by three edges 92*a-c* with attached cylindrical arm 94 ending with cam connector 96. Cam connector 96 has an approximate shape of ellipsis-quarter cut-off by surfaces of three types 96*a*, 96*b* and 96*c* similar to the one disclosed by Rubik and later by Sugden and fits into 3-D space limited by cuboid cam connectors of neighbor cylindrical elements and spherical surfaces of central cylindrical elements 30, 40 and 50. As shown in FIG. 9D element 90 has flat surface 90*a* at the bottom side limited by arc 90*b* going along the central axis of curved cylindrical element.

FIG. 10 represents the second sub-group of two minor reflected corner-Elbows 100 and 110 that serve as starting and ending elements of the puzzle. FIG. 10A shows volumetric view, FIG. 10B shows front view, FIG. 10C shows top view and FIG. 10D shows bottom view of entry point corner-Elbow 100. Unexposed part of cylindrical element 100 has a shape of cube corner formed by edges 102*a-c* and arc edges 100*b* and 100*d* with respective flat surfaces 100*a* and 100*c*. A cylindrical arm 104 is attached to the unexposed corner of Elbow 100 ending with cam connector 106 identical to cam connector 96 described above. FIG. 10E shows bottom view of exit point corner-Elbow 110, which is mirror reflected copy of element 100. It has the similar flat surfaces at unexposed sides, and surface 110*c* is located between edges 112*a,b* and arc edge 110*d*.

Figure 11:
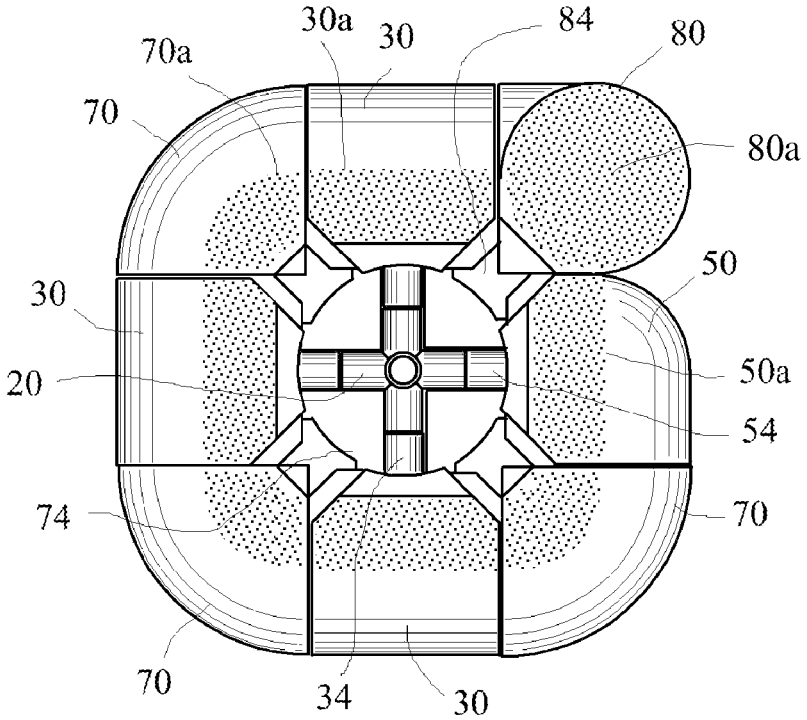
FIG. 11 shows views of unexposed sides of the assembled tube puzzle: A—without top layer, B—without two upper layers.
Figure 11:
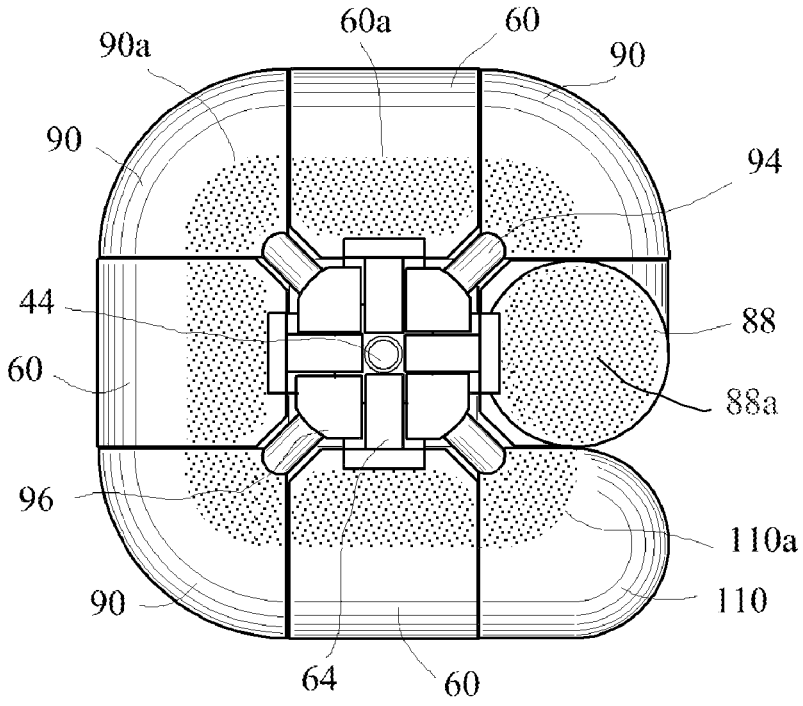

FIG. 11 shows two views of unexposed sides of the assembled tube puzzle. FIG. 11A shows a top view of assembled Middle layer with removed Top layer of the puzzle. Arm connectors 34 and 54 of central tube elements 30 and 50 are connected to the central connecting mechanism 20 based on the same mechanical principles disclosed by Rubik in HU 170,062. Corner mid-Elbows 70 and 80 are inserted between neighbor central elements 30 and 50 so that arm-and-cam connectors 74 and 84 keep them attached to central elements forming the Middle layer. Tube elements' unexposed surfaces can be made flat, as marked by shaded gray areas 30*a*, 50*a*, 70*a* and 80*a* in order to stabilize sliding motion of element arrays while rotation.

FIG. 11B shows view of unexposed side of assembled puzzle Bottom layer with removed two upper layers. Square cuboid shape connectors 64 of mid-elements 60 and 88 receive Cam connectors 96 of corner tube elements 90 and 110. Arm connector 44 of Container element 40 is located in the center and when connected to the central connecting mechanism keeps the Bottom layer attached to the Middle layer. Flat surfaces 60*a*, 88*a*, 90*a* and 110*a* provide stable rotation of element arrays and are shaded by gray color.

Cubical parts of all elements of the present puzzle not only stabilize the sliding motion of element arrays but they block visibility of element unexposed internal sides with arm-and-cam connectors and cut-offs except some features of Elbow elements such as flattened surfaces of elements 80, 100 and 110 or corners of elements 40 and 50.

Figure 12:
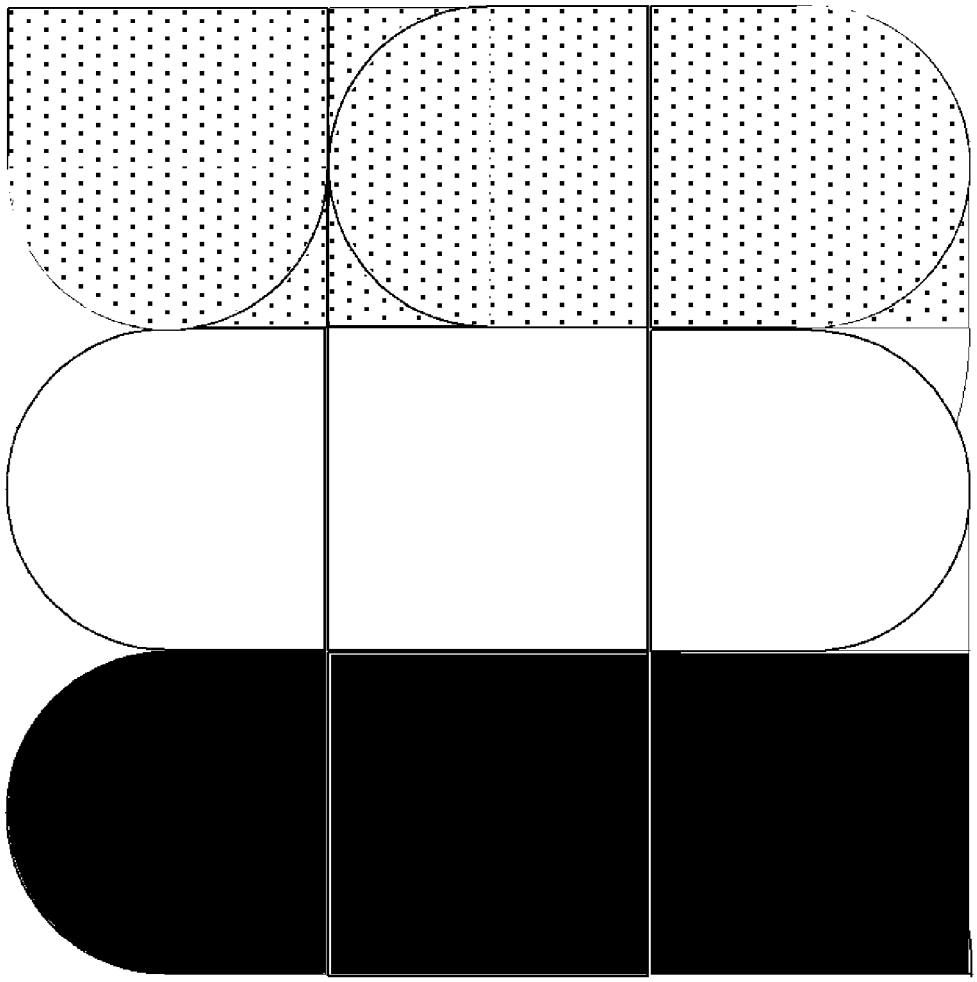
FIG. 12 shows side view of three-gray-scale-level tube puzzle.

FIG. 12 shows front view (similar to one shown in FIG. 2B) of three-gray-scale-level puzzle. Top layer of the puzzle has gray color, Middle layer is white and Bottom layer is black.

FIGS. 13A-13H show all types of hollow elements of the tube puzzle in isometric views that correspond respectively to cylindrical elements shown on FIGS. 3-10: A—to FIG. 3A, B—to FIG. 4A, C—to FIG. 5A, D—to FIG. 6A, E—to FIG. 7A, F—to FIG. 8A, G—to FIG. 9A, H—to FIG. 10A.

Figure 13:
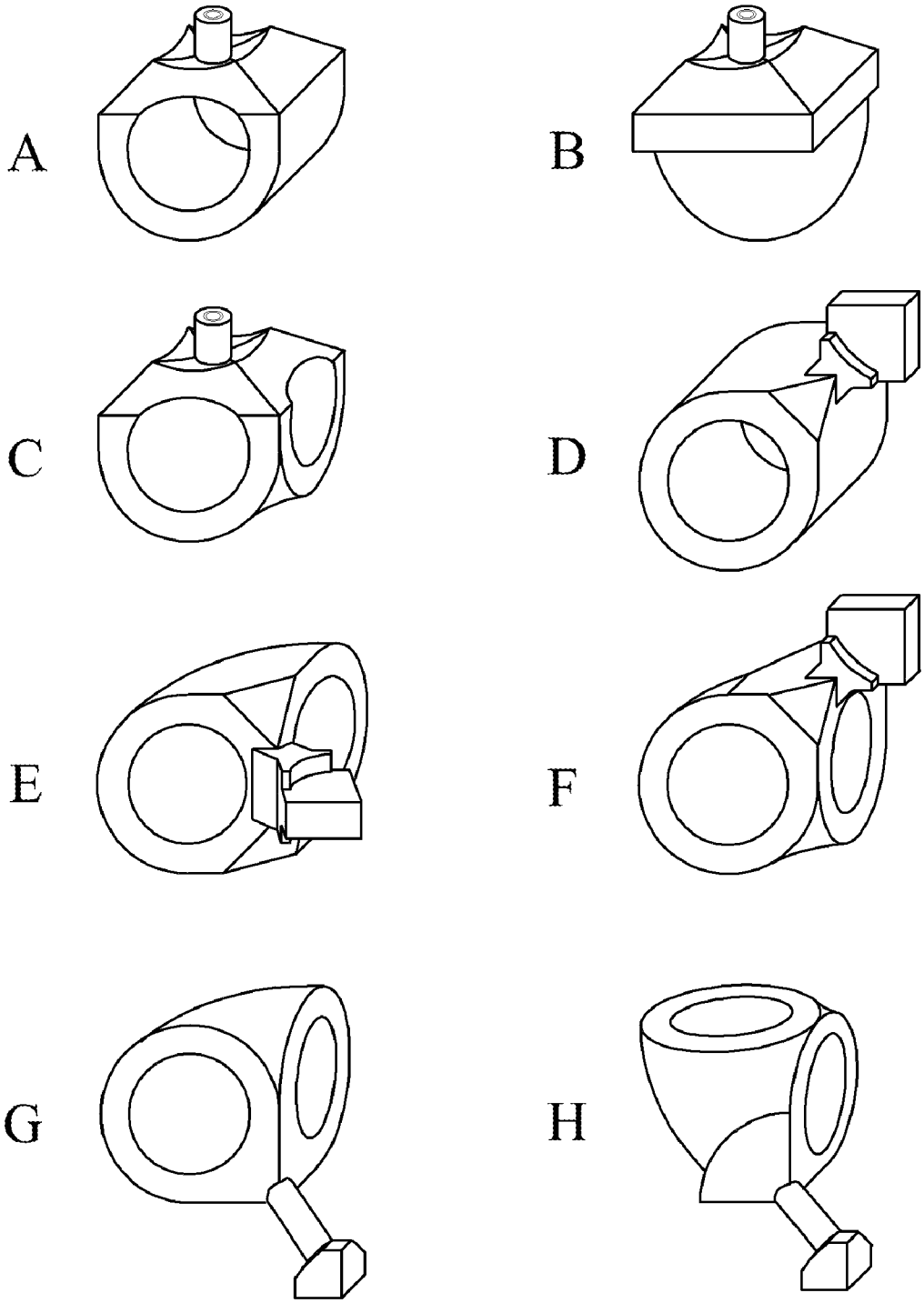
FIG. 13 shows all types of hollow elements of the tube puzzle in isometric views.
Figure 14:
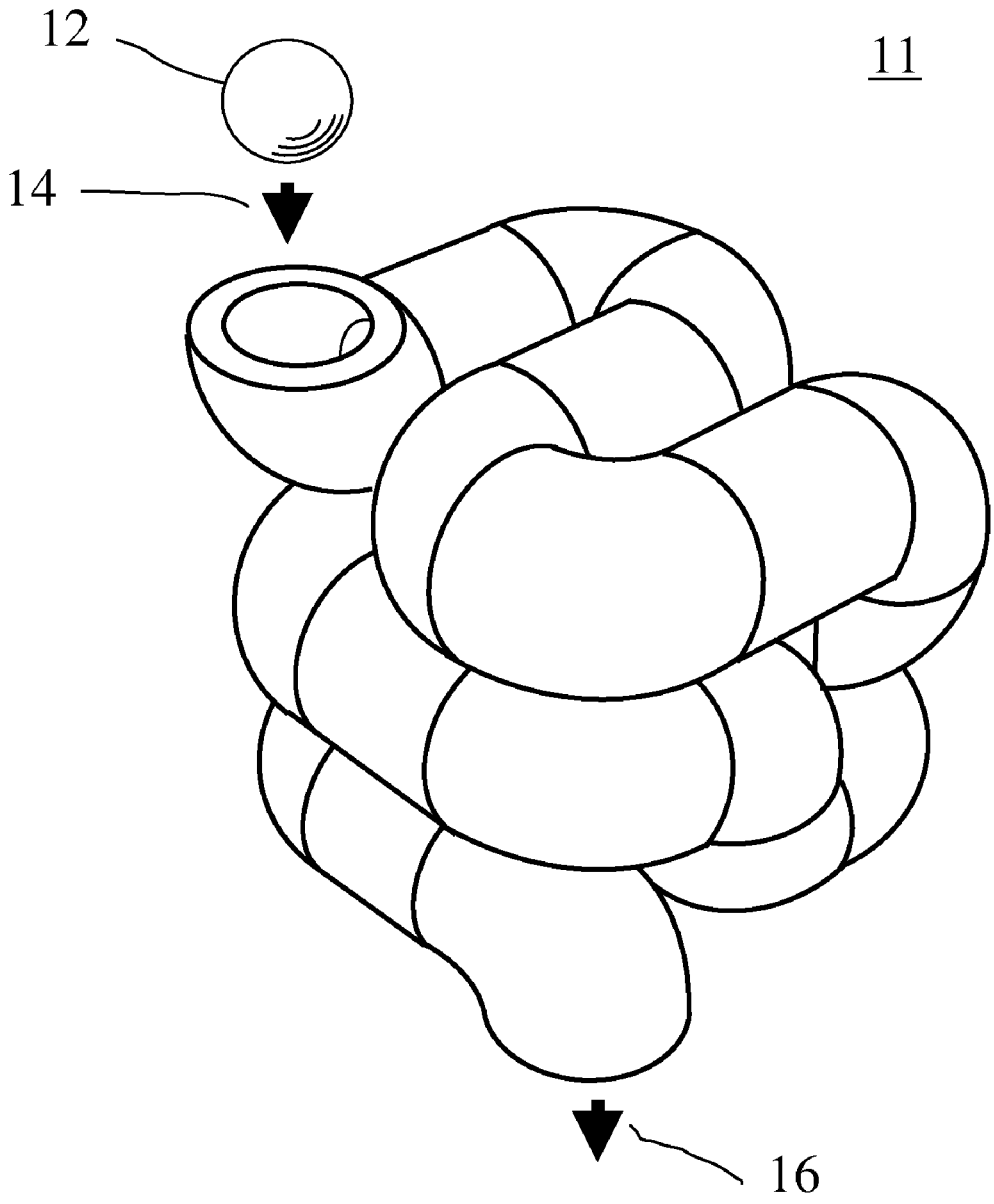
FIG. 14 represents three-dimensional tube puzzle in assembled state consisted of hollow elements in accordance with the embodiment of the present invention.

FIG. 14 shows a volumetric view of assembled tube puzzle 11, which is similar to one shown in FIG. 1 but consisting of hollow elements shown in FIG. 13. An article 12 of size smaller than internal tube diameter can be put though the puzzle from its entry point 14 and released at its exit point 16.

Figure 15:
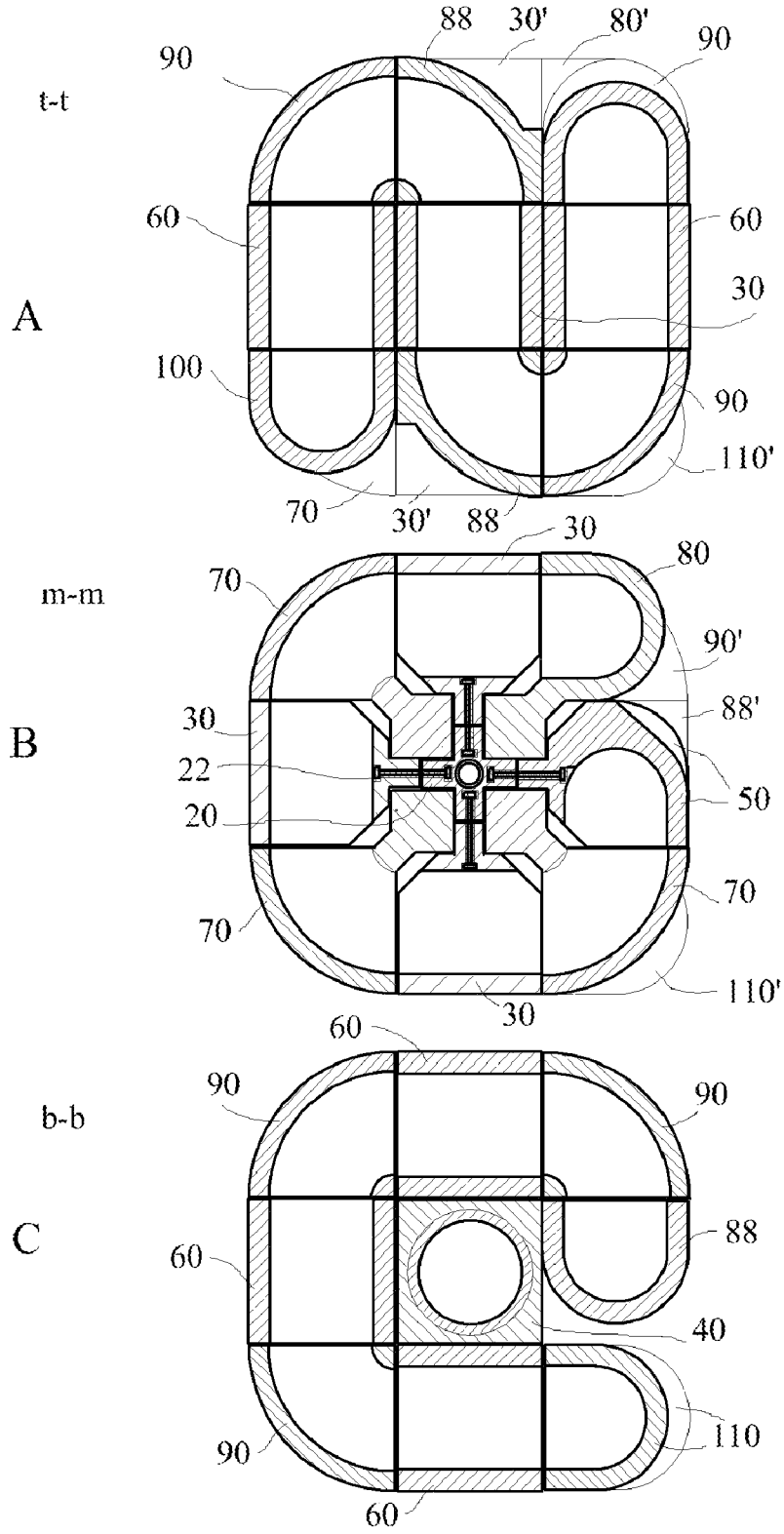
FIG. 15 shows top views of horizontal cross-sections of the tube puzzle layers along the central lines t-t, m-m and b-b in FIG. 2B: A—top layer along the line t-t, B—middle layer along the line m-m, C—bottom layer along the line b-b.

FIG. 15 represents three cross-sections of disclosed puzzle layers. FIG. 15A shows cross-section of the Top layer of puzzle 11 along the line t-t in FIG. 2B viewed from top. Assembled Top layer forms a continuous pipeline way for an article 12 beginning with entry point corner-Elbow 100 and ending with corner-Elbow 90, which provides transition to the lower Middle layer. FIG. 15B shows cross-section of the Middle layer of puzzle 11 along the line m-m in FIG. 2B viewed from top. Assembled Middle layer forms a continuous pipeline way for an article 12 beginning with corner-Elbow 80 and ending with central Elbow 50, which provides transition to the lower Bottom layer. Central connecting mechanism 20 is connected to central Couplings 30 and central Elbow 50 based on the same mechanics 22 disclosed by Rubik in HU 170,062. FIG. 15C shows cross-section of the Bottom layer of puzzle 11 along the line b-b in FIG. 2B viewed from top. Assembled Bottom layer forms a continuous pipeline way for an article 12 beginning with mid-Elbow 88 and ending by exit point corner-Elbow 110. The central element is presented by Container 40 without cap 46 shown in FIG. 4.

Figure 16:
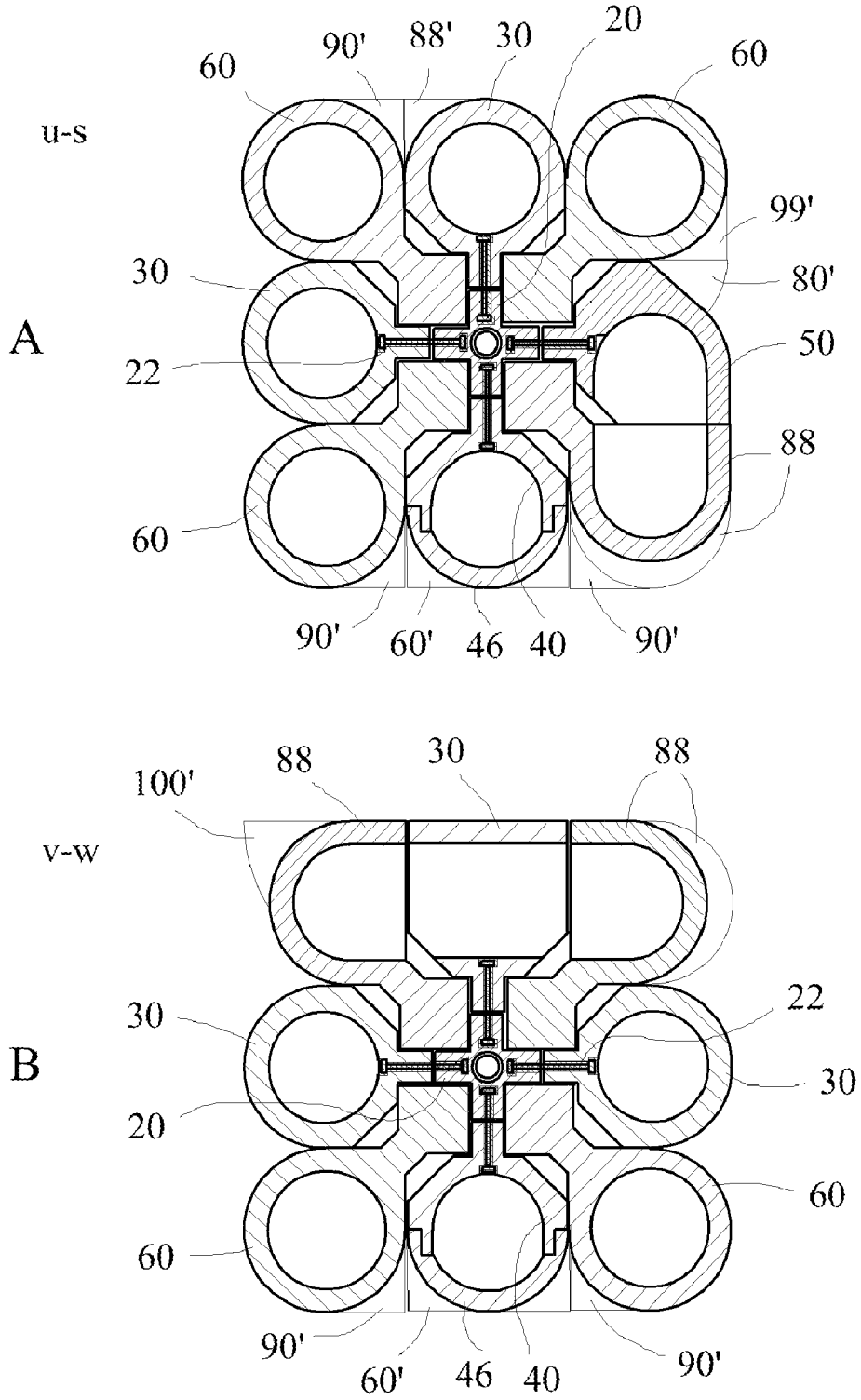
FIG. 16 shows side views of vertical cross-sections of the tube puzzle along the central lines u-s and v-w in FIG. 2A.

FIG. 16 represents two cross-sections of the puzzle along two perpendicular planes. FIG. 16A shows central cross-section of the puzzle along the line u-s in FIG. 2A viewed from point w. FIG. 16B shows central cross-section of the puzzle along the line v-w in FIG. 2A viewed from point s. Central tube elements 30, 40 and 50 are connected to central connecting element 20 using the same mechanics 22 disclosed by Rubik in HU 170,062. Tube elements 60, 80, 88, 90 and 100 are kept between central elements by their arm-and-cam connectors.

As described above, several critical modifications were made for unexposed element parts and connectors disclosed by Rubik, Sugden and other cited patents in order to provide feasibility and functionality of the tube puzzle disclosed in the present invention. Exposed element cylindrical shapes required providing an internal unexposed flat side surfaces to stabilize sliding motion while element rotation and to hide puzzle interior. Those flat surfaces required a reduction of the puzzle internal space used for element interconnection. The latter required in turn cam connectors to be extended with arms of specific shapes for different elements. Further modification was made by pyramidal cut-offs of provided internal unexposed flat side surfaces of cylindrical elements in order to provide enough space for connectors' extension arms to pass through while element rotation. Puzzle internal space used for element interconnection can be reduced up to single element space in order to provide maximal stability of rotation and maximal diameter of internal tube path in case of hollow cylindrical elements. All described modifications are shown in FIGS. 3-11, 13, 15-16 and resulted in seven types of elements with exposed straight and curved cylindrical shapes and one element with exposed spherical shape required to form the 3×3×3 tube puzzle disclosed in the present invention. Instead only three types of elements are required to form a 3×3×3 cube puzzle known in the art.

Figure 17:
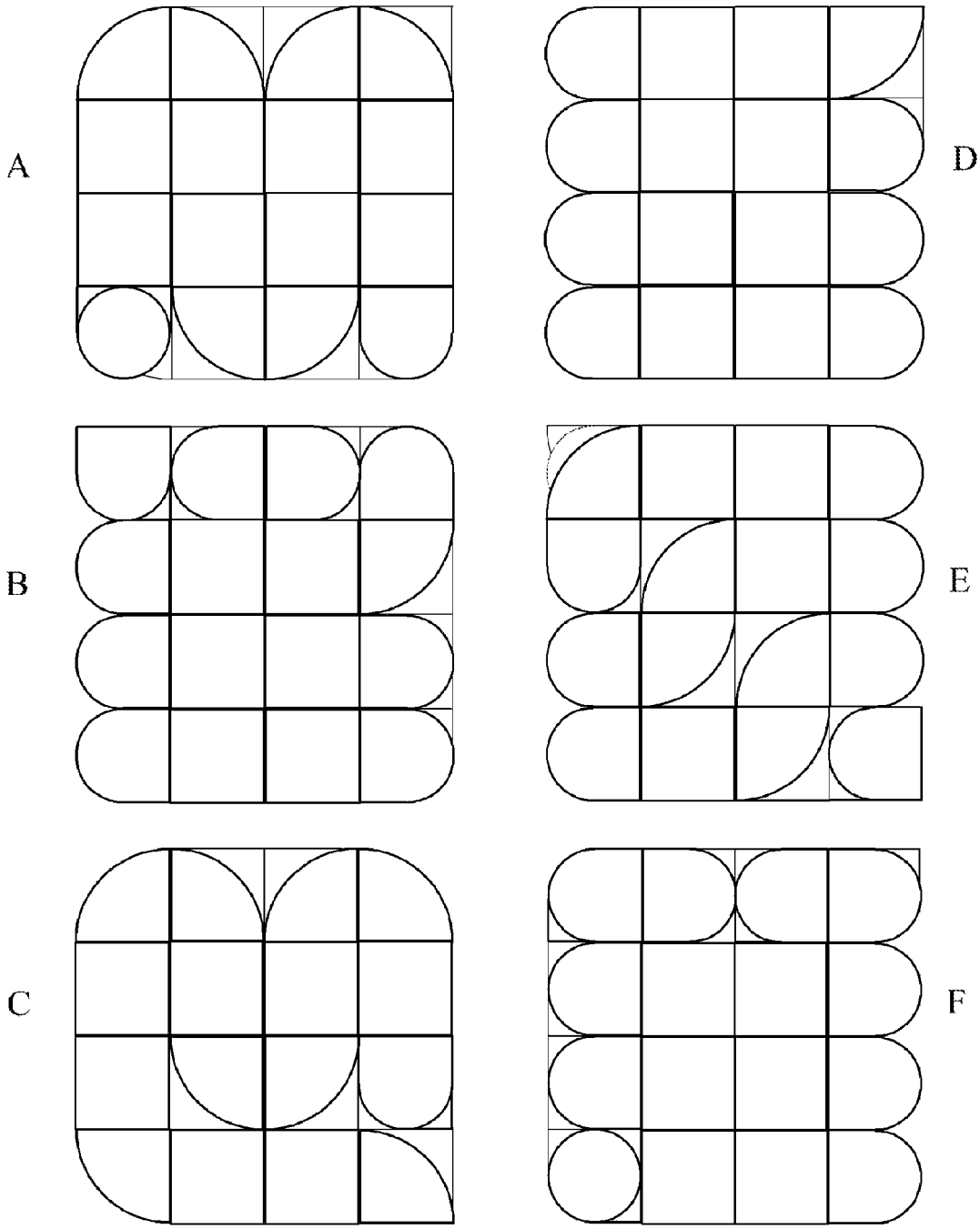
FIG. 17 shows views of six side surfaces of 4×4×4 tube puzzle: A—top, B—front, C—bottom, D—left, E—right, F—back.
Figure 18:
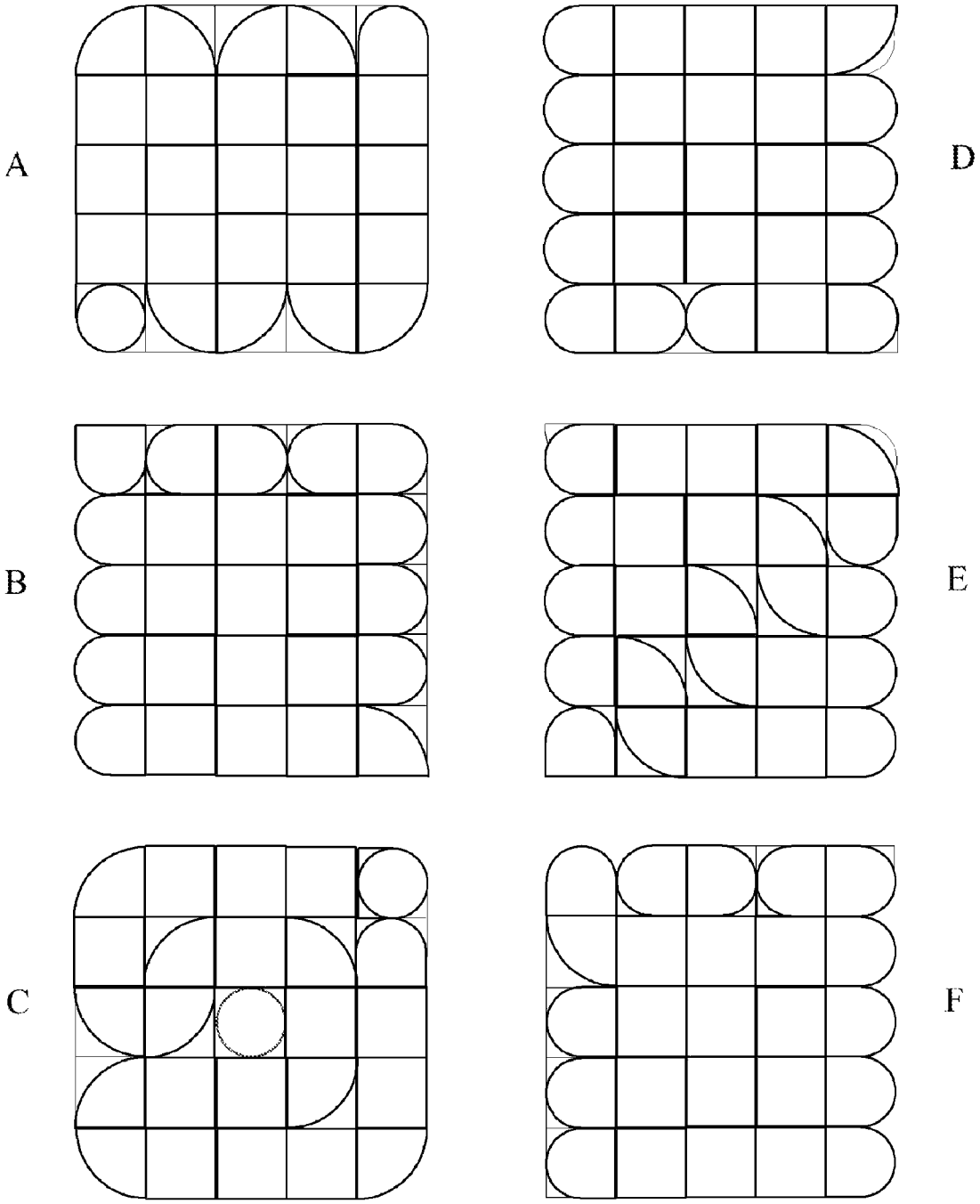
FIG. 18 shows views of six side surfaces of 5×5×5 tube puzzle: A—top, B—front, C—bottom, D—left, E—right, F—back.

The disclosed in the present invention 3×3×3 tube puzzle can be extended to 4×4×4 tube puzzle as shown in FIG. 17 or to 5×5×5 tube puzzle as shown in FIG. 18 based on the same principle of extension arms for connectors and providing flat surfaces for unexposed parts of cylindrical elements disclosed in the present invention and following mechanical principles disclosed by Sebesteny in U.S. Pat. No. 4,421,311 and by Krell in U.S. Pat. No. 4,600,199 respectively for element interconnection. In 4×4×4 extended version of tube puzzle a container element with exposed spherical shape is optional since all cells of the puzzle can be filled out by tube elements. Extended 4×4×4 or 5×5×5 tube puzzle elements can be hollow and can be the same one color or transparent or can be respectively 4 or 5 gray scale levels belonging to each of 4 or 5 puzzle layers respectively or can represent a sequence of colors equivalent to discrete rainbow spectrum analogically to described above 3×3×3 tube puzzle.

All elements' and connectors' dimensions and shapes disclosed in the present invention are shown to reveal the principal structure, features and functioning of the tube puzzle and can be adjusted and slightly rounded during injection molding manufacture process in order to provide smooth and stable rotation of tube element arrays. Configuration of continuous pipeline in initial state of tube puzzle of any size can be produced variable. Arm-and-cam connectors can be maid hollow in order to save material.

The disclosed tube puzzle and an article can be designed in a form of identifiable objects, creatures or characters to resemble an identifiable environment, e.g. a tunnel structure with a racing car or a snake swallowing a prey or any other.

While the above is a complete description and illustration of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A spatial manipulable puzzle toy, comprising:

a plurality of toy elements of exposed straight and curved cylindrical shapes, wherein each said toy element having equal maximal size in each of three dimensions, and said toy elements interconnected to form a rotatable three-dimensional structure with six sides, and said toy elements forming groups of toy elements at each of said six sides of said three-dimensional structure, and each said group of toy elements rotatable about a spatial axis going through each group central element and interior central point of said puzzle; and means for said toy elements interconnection to each other and to internal central connecting mechanism to form a rotatable continuous curved cylindrical structure in an undisturbed state of said puzzle with starting and ending said toy elements, and a gap in said continuous curved cylindrical structure is filled with one toy element of exposed spherical shape.

2. The spatial puzzle toy of claim 1, wherein said plurality of said toy elements including one toy element of exposed spherical shape having equal maximal size in each of three dimensions.

3. The spatial puzzle toy of claim 1, wherein said means having the form of arm-and-cam connectors attached to the unexposed parts of said toy elements, wherein said arm-and-cam connectors having the form of cam connectors with attached extension arms of specific shapes for different said toy elements; and wherein said unexposed parts of said toy elements having the form of flat side surfaces that are pyramidally cut-off.

4. The spatial puzzle toy of claim 1, wherein said toy elements are of the same one color.

5. The spatial puzzle toy of claim 1, wherein said toy elements are of three different colors or three gray scale levels, wherein said toy elements forming the top layer of said puzzle with said starting element are of the same one color or gray scale level, said toy elements forming the middle layer of said puzzle are of the same second color or gray scale level, and said toy elements forming the bottom layer of said puzzle with said ending element are of the same third color or gray scale level in an undisturbed state of said puzzle.

6. The spatial puzzle toy of claim 1, wherein said toy elements are of different gray scale levels and form a sequence of discrete gray scale levels from said starting element gray scale level to said ending element gray scale level when each element gray scale level matches preceding and subsequent element gray scale levels in an undisturbed state of said puzzle.

7. The spatial puzzle toy of claim 1, wherein said toy elements are of different colors and form a color sequence that represents discrete color spectrum from said starting element color to said ending element color when each element color matches preceding and subsequent element colors in an undisturbed state of said puzzle.

8. The spatial puzzle toy of claim 1, wherein said toy elements of exposed straight and curved cylindrical shape are hollow and form a continuous curved tube structure with starting and ending points for an article to pass through the puzzle in an undisturbed state of said puzzle.

9. A spatial manipulable puzzle toy, comprising:

25 toy elements of exposed straight and curved cylindrical shapes and 1 toy element of exposed spherical shape, wherein each said toy element having equal maximal size in each of three dimensions, and said toy elements interconnected to form a rotatable 3×3×3 three-dimensional structure with six sides, and said toy elements forming groups of 9 toy elements at each of said six sides of said three-dimensional structure, and each said group of toy elements rotatable about a spatial axis going through each group central element and interior central point of said puzzle; and said toy elements are interconnected to each other and to internal central connecting mechanism to form a rotatable continuous curved cylindrical structure in an undisturbed state of said puzzle with starting and ending said toy elements, wherein interconnection is made by means of arm-and-cam connectors, wherein cam connectors having extension arms of specific shapes for different said toy elements attached to the unexposed parts of said toy elements that have flat side surfaces that are pyramidally cut-off.

10. The spatial puzzle toy of claim 9, wherein said toy elements are of the same one color.

11. The spatial puzzle toy of claim 9, wherein said toy elements are of three different colors or three gray scale levels, wherein said toy elements forming the top layer of said puzzle with said starting element are of the same one color or gray scale level, said toy elements forming the middle layer of said puzzle are of the same second color or gray scale level, and said toy elements forming the bottom layer of said puzzle with said ending element are of the same third color or gray scale level in an undisturbed state of said puzzle.

12. The spatial puzzle toy of claim 9, wherein said toy elements are of different 25 gray scale levels and form a sequence of discrete gray scale levels from said starting element gray scale level to said ending element gray scale level when each element gray scale level matches preceding and subsequent element gray scale levels in an undisturbed state of said puzzle.

13. The spatial puzzle toy of claim 9, wherein said toy elements are of different 25 colors and form a color sequence that represents discrete color spectrum from said starting element color to said ending element color when each element color matches preceding and subsequent element colors in an undisturbed state of said puzzle.

14. The spatial puzzle toy of claim 9, wherein said toy elements of exposed straight and curved cylindrical shape are hollow and form a continuous curved tube structure with starting and ending points for an article to pass through the puzzle in an undisturbed state of said puzzle, and wherein said toy element of exposed spherical shape is hollow having an opening cap and serves as a container for said article.

* * * * *